US007363972B2

(12) United States Patent
Dybdahl

(10) Patent No.: US 7,363,972 B2
(45) Date of Patent: Apr. 29, 2008

(54) METHOD AND APPARATUS FOR WELL TESTING

(75) Inventor: Bjorn Dybdahl, Haugesund (NO)

(73) Assignee: Petrotech ASA, Haugesund (NO)

( * ) Notice: Subject to any disclaimer, the term of this patent is extended or adjusted under 35 U.S.C. 154(b) by 0 days.

(21) Appl. No.: 10/363,816

(22) PCT Filed: Aug. 28, 2001

(86) PCT No.: PCT/NO01/00351

§ 371 (c)(1),
(2), (4) Date: Sep. 10, 2003

(87) PCT Pub. No.: WO02/20944

PCT Pub. Date: Mar. 14, 2002

(65) Prior Publication Data

US 2004/0050548 A1 Mar. 18, 2004

(30) Foreign Application Priority Data

Sep. 5, 2000 (NO) ..... 20004439

(51) Int. Cl.
*E21B 49/08* (2006.01)

(52) U.S. Cl. ..... 166/264; 166/250.01; 73/152.24; 73/152.55

(58) Field of Classification Search ..... 166/264, 166/250.01, 373, 169; 73/152.55, 152.24, 73/152.33, 64.56
See application file for complete search history.

(56) References Cited

U.S. PATENT DOCUMENTS 4,903,765 A 2/1990 Zunkel
5,329,811 A 7/1994 Schultz et al.
5,335,542 A * 8/1994 Ramakrishnan et al. . 73/152.08
5,337,822 A 8/1994 Massie et al.
5,361,839 A 11/1994 Griffith et al.
5,635,631 A 6/1997 Yesudas et al.
5,662,166 A 9/1997 Shammai
5,901,788 A * 5/1999 Brown et al. ..... 166/264
6,092,416 A * 7/2000 Halford et al. ..... 73/152.23
6,128,949 A 10/2000 Kleinberg
6,343,507 B1 * 2/2002 Felling et al. ..... 73/152.19

* cited by examiner

*Primary Examiner*—Jennifer H. Gay
*Assistant Examiner*—Daniel P Stephenson
(74) *Attorney, Agent, or Firm*—Fulbright & Jaworski LLP

(57) ABSTRACT

A method for testing petroleum or water wells. A tool is secured to a tubing and run into the well and to the reservoir zone to be explored. An upper and a lower seal isolate the reservoir zone. A piston is run into the tubing and pumped down to the tool. When sampling is to take place, a valve is opened and the reservoir fluid, together with drilling fluid filling the well, is allowed to enter the tool while displacing the piston. At the same time, measuring is carried out to identify a tracer added to the drilling fluid. When the tracer no longer can be traced, the drilling fluid contaminated reservoir fluid is displaced out of the tool by the piston and clean reservoir fluid is allowed to enter the tool. The invention also relates to an apparatus for practising the method.

10 Claims, 7 Drawing Sheets

METHOD AND APPARATUS FOR WELL TESTING

This invention relates to a method and apparatus for testing petroleum wells/water wells, and apparatus for practicing the method.

In the exploration phase of a petroleum well it is necessary, in order to determine the reservoir properties, to measure relatively accurately many physical and chemical parameters. By reservoir properties are meant here both the properties of the fluids stored in the reservoir, the properties of the formation minerals and the prevailing flow-technical properties, for example with respect to permeability, sand rate, porosity and flow volume.

Typically the exploration comprises measuring the reservoir pressure and temperature, the density of the reservoir fluid by means of a gamma log, water saturation by means of a resistivity gauge, porosity by means of a neutron gauge, permeability and porosity by means of a nuclear magnetic resonance gauge. The chemical composition must also be examined. Further measuring is carried out to determine the so-called saturation point of the well fluid (oil boiling point, gas dew point). These measurements form the basis for the preparation of a so-called Pressure Volume Temperature (PVT) Diagram.

Mainly two methods are used to acquire information about the properties of a reservoir. The older method is the so-called Drill Stem Testing (DST) which presupposes that the well is provisionally completed, so that the reservoir fluid may flow to the surface where fluid samples are filled into compression tanks. Alternatively, a compression tank may be lowered by means of a wireline into the underground fluid reservoir itself where the compression tank is filled up with fluid and then closed, after which it is transported to the surface for analysis locally or to be shipped to a laboratory. The fluid flowing up from the well is burnt in a flare stack. The drill stem test (DST) provides extensive and, for most kinds of samples, also reliable results. However, relatively much time and resources are spent on carrying out the testing according to this method, which may also imply considerable polluting of air and water. Another negative feature of the method is that the fluid samples must be brought to the surface where the temperature is lower than in the reservoir. This also causes pressure and temperature variance relative to the conditions of the reservoir. When acquiring data to determine the saturation point of the fluid, it is crucial that the testing is carried out at the pressure and temperature of the reservoir in order to obtain a correct result. Therefore, the pressure and temperature must normally be increased before the testing/analysis can be carried out, which means uncertainty with respect to the gas/oil shares, wax and asphaltenes in the oil of the reservoir.

Another method, the so-called Wireline Formation Testing and Sampling (WFT/WFS) was adopted in the 1970s and involves that measuring equipment and a sample container are lowered by means of a cable/wireline into an uncased well, which is full of drilling fluid (mud), where measuring is carried out. A smaller fluid sample may be brought to the surface. After continuous development, the method has been given an embodiment in which the apparatus, which is lowered into the well, is provided with remote-controlled instruments which communicate data to the surface during measuring. It is not possible to simulate a real production situation by means of this method because only very small amounts of the reservoir fluid are extracted. It may also be difficult to make sure that drilling fluid (mud) does not affect the measuring results.

The object of the invention is to remedy the negative aspects of the established techniques.

The object is realized through a novel method of acquiring the necessary data, as appears from the description below and the following Claims.

During the drilling through a formation a tracer may be added to the drilling fluid. By measuring the content of tracer in the well, it may subsequently be determined when the tracer and thereby the drilling fluid have been removed from the measuring area. Alternatively an analysis of the drilling fluid may be done, which is then compared with the fluid of the well in order to determine when the drilling fluid has been removed. The method is known by the name "the Fingerprint Method".

In the preparations for testing, the drill pipe with the drill bit is pulled out of the well. A combination tool is secured to the free end portion of a drill pipe/tubing/coiled tubing and run into the well. In the following this pipe is called tubing. At the location of exploration, the well may be open (open hole) or provided with casing, the casing being perforated at the zone to be tested. Dry seal plugs/elements sealing off the well above, below and possibly between the reservoir zones to be explored, are attached to the combination tools at intervals adjusted to the thickness(es) of the reservoir zone(s). The lower dry seal plug/element may possibly be set before the combination tool is run into the well. In operations in an uncased well the dry seal plugs/elements tighten directly against the well formation. For safety reasons, in such operations a third dry seal plug/element is set higher up in the cased well section. The dry seal plugs/elements may be provided with remote-controlled valves. A batching pig/piston (in the following referred to as a batching pig) is run into the tubing through a gate at the surface, and is pumped down by means of pressurized fluid to the combination tool. The fluid, normally drilling fluid, displaced by the batching pig as this is displaced downwards, flows through a circulation outlet valve of the combination tool, a valve of the upper dry seal plug/element up through the annulus between the casing and tubing. A washing agent may be supplied to the tubing before the batching pig is pumped down, in order to wash the so-called filter cake in connection with the reservoir. Washing circulation may be run in both directions. In one embodiment the batching pig may be provided with a valve which is arranged to allow fluid circulation through the pig, possibly also with measuring equipment, for example for temperature, pressure, fluid identification and position. The valve of the batching pig also allows circulation through the tubing if the batching pig should get stuck in the tubing. If desirable, the batching pig may also be provided with an electrically or hydraulically driven propulsion device with position indication in order to increase the accuracy of movement of the batching pig. Alternatively the position of the batching pig may be determined by so-called volume points.

The method according to the invention comprises two typical alternative methods, in the following referred to as alternative "A" and alternative "B", for the treatment of the reservoir fluid contaminated with drilling fluid.

In both methods in question, a choke valve is opened in the tubing at the surface and reservoir fluid flows out of the reservoir through the reservoir inflow valve of the combination tool. In the alternative A method the batching pig is displaced up through the tubing by the inflowing reservoir fluid contaminated with drilling fluid, while at the same time fluid-measuring is carried out in the combination tool to identify a tracer added to the drilling fluid in advance, alternatively by the use of the Fingerprint Method to determine when the area has been cleaned of drilling fluid. A reservoir inflow valve may comprise one or more valves and ports. When the tracers can no longer be traced or the drilling fluid analysis can no longer be recognized, the reservoir inflow valve of the combination tool is closed, whereby the contaminated fluid is trapped. The lower end of the combination tool is connected to the lower dry seal plug/element, and the valve of the lower dry seal plug/element is opened, so that the fluid column staying in the tubing below the batching pig by means of fluid pressure against the top side of the batching pig, is pumped down through the lower dry seal plug/element into an underlying chamber/well. The valve of the lower dry seal plug/element is closed. The reservoir inflow valve of the combination tool is opened and reservoir fluid enters the tubing/drill pipe, driving the batching pig upwards.

The climbing speed and thereby the production volume may be measured directly or calculated from displaced fluid volume flowing in front of the batching pig into a receptacle on the surface provided with measuring equipment.

In alternative B the reservoir fluid contaminated with drilling fluid flows through the valve of the batching pig up through the tubing. After the well in the reservoir area has been cleaned of drilling fluid, the valve of the batching pig is closed and the batching pig is moved upwards by the clean reservoir fluid.

In a further alternative the fluid column contaminated with drilling fluid is not pumped down into another chamber, but rises in the tubing together with the reservoir fluid when the reservoir fluid is flowing into the tubing.

A volume of reservoir fluid is then produced, after which the reservoir inflow valve at the inlet opening of the combination tool is closed, thus isolating this clean fluid quantity/sample from all other fluids in the well. It must be possible to carry out the production very slowly in order not to disturb the state of the formation fluid through loss of pressure. By moving the batching pig/element upwards in a controlled manner and at the same time reading and logging the temperature gradient of the closed sample chamber and the volume, pressure and temperature of the sample, a volume pressure temperature diagram and a saturation point curve for the reservoir fluid may be prepared without removal of the reservoir fluid from the well. Other measurements, e.g. multi-phase quantity gauging, mass flow, fluid identification, density, conductivity, pH, composition of hydrocarbon fluid and ionic composition of water are carried out by suitable measuring equipment in the combination tool. Mercury level and hydrogen sulphide content are measured to determine the quality of the reservoir fluid, possibly its corrosiveness. During testing and analysing smaller samples may be isolated in separate chambers constructed to preserve the properties of the reservoir fluid all the way until the sample arrives at the laboratory on the surface or on shore. The details and operation of the sample chambers are described in the particular section of the description.

The pressure on the top surface of the batching pig/element is relieved and the reservoir inflow valve is opened, so that reservoir fluid enters the tubing. The batching pig is displaced towards the surface by the entering reservoir fluid, and measurements in order to gain understanding of the flow properties of the reservoir fluid in the reservoir rock, may be carried out in the combination tool. Thereupon the reservoir fluid may be pumped back to the same reservoir, or possibly into another reservoir of the same well.

Should the reservoir pressure be too low, so that necessary parameters cannot be registered, fluid in the tubing above the batching pig may be pumped out and replaced by nitrogen to lighten the pressure on the top side of the batching pig, so that the batching pig/element rises. The fluid above the batching pig/element may possibly be replaced by a fluid of lower specific gravity. As mentioned above, the batching pig may also be provided with propulsion machinery.

In the following there will be described a non-limiting example of a preferred embodiment visualized in the accompanying drawings, in which.

Figure 1:
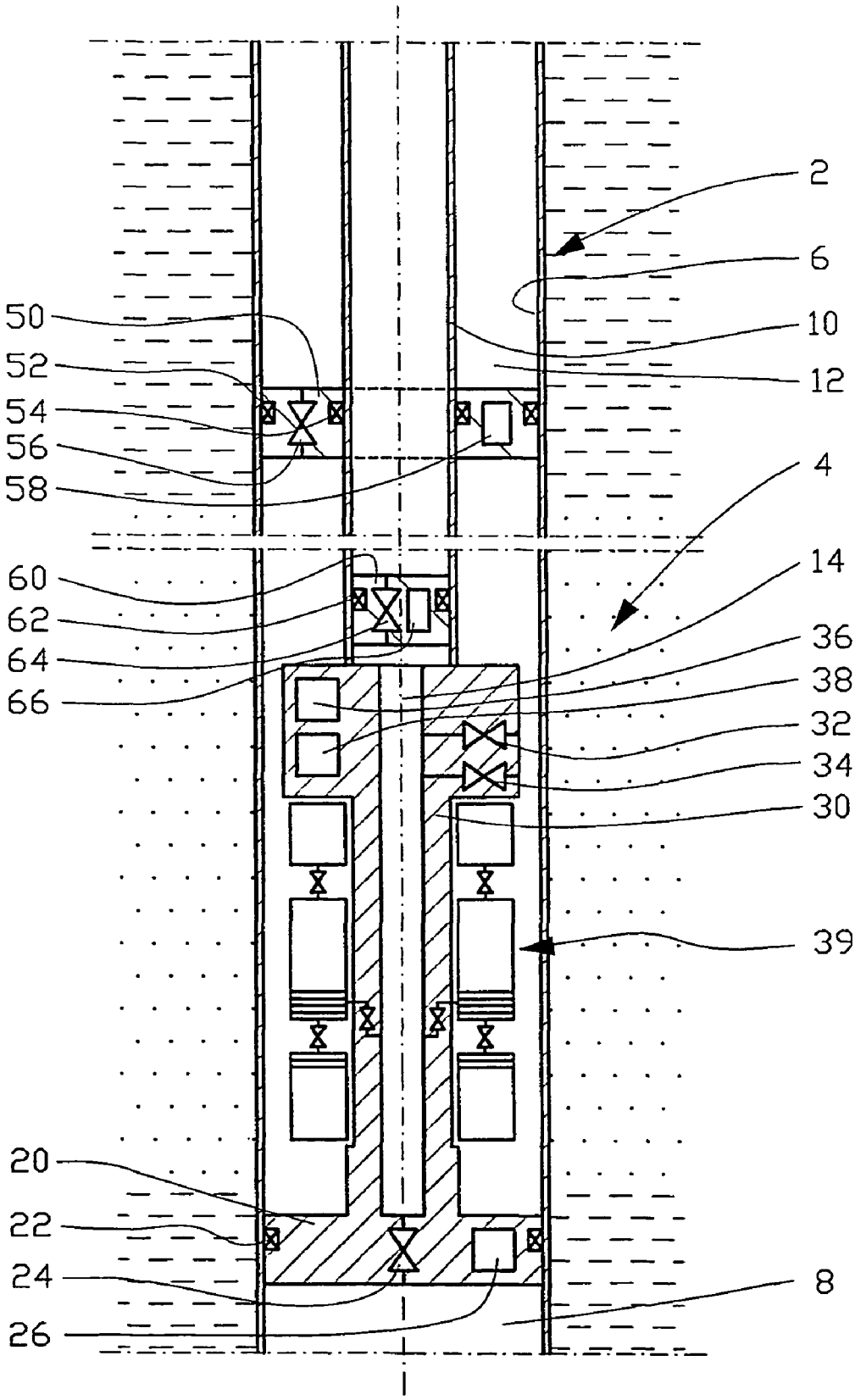
FIG. 1 shows schematically a petroleum well prepared for testing, in which a lower dry seal plug/element, combination tool, upper dry seal plug/element and batching pig have been run into the well.
Figure 6:
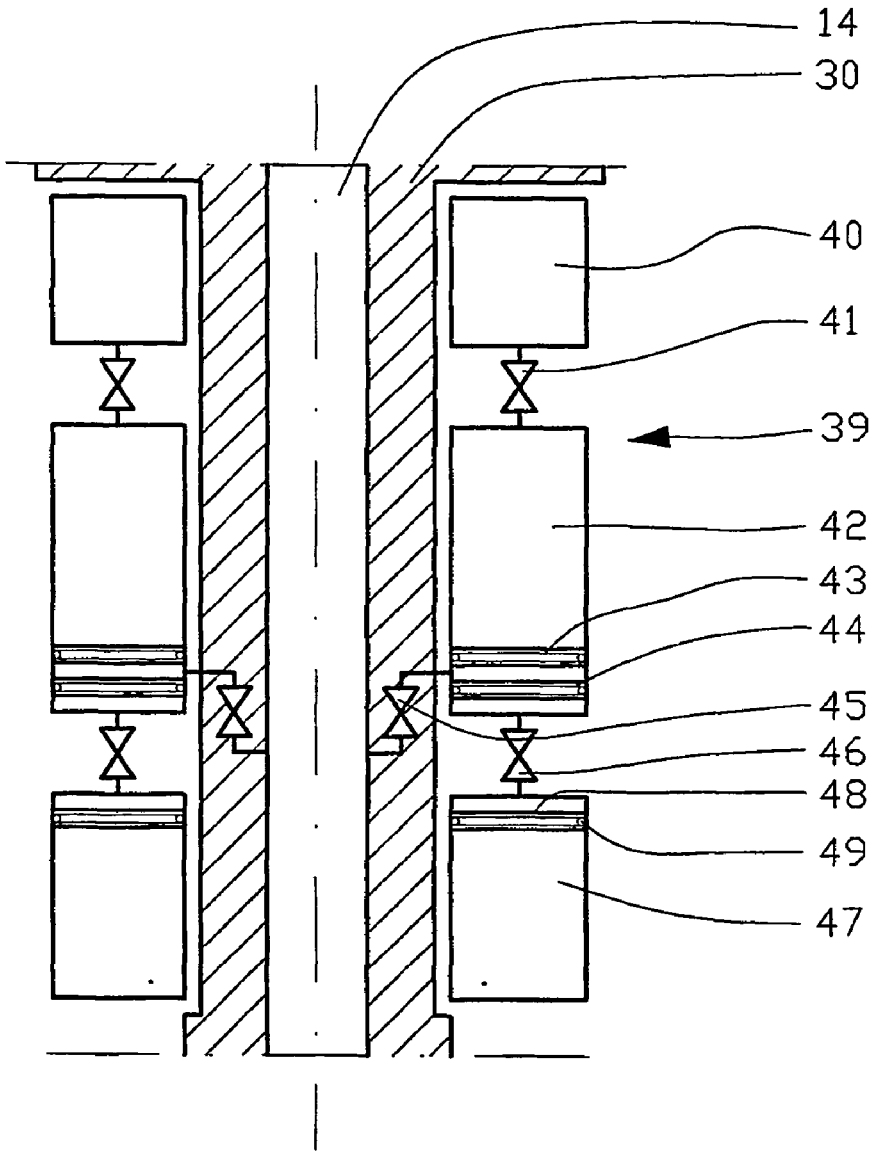
FIG. 6 shows, on a larger scale, the configuration of the sample chambers in a non-filled state.
Figure 7:
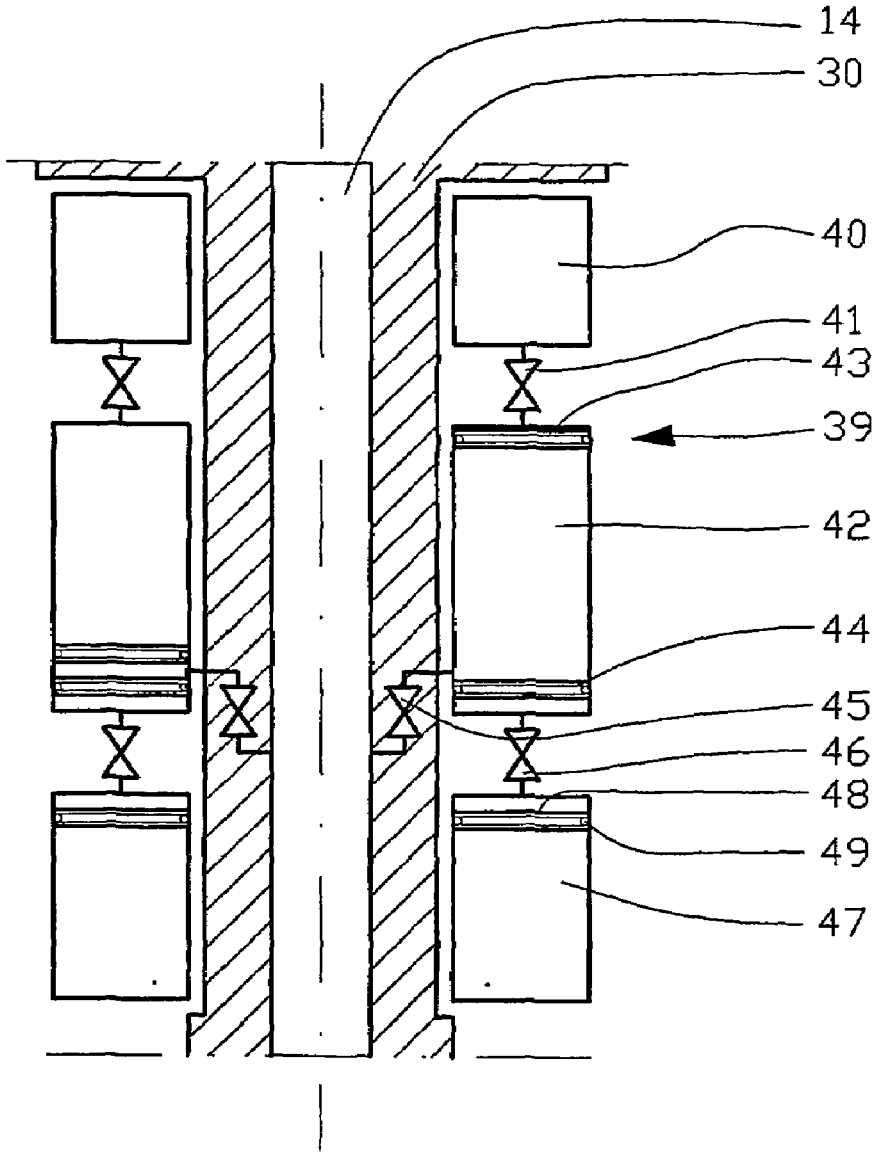
FIG. 7 shows, on a larger scale, the configuration of the sample chambers in a filled state.

In the drawings the reference numeral 2 identifies a well drilled into a petroleum reservoir 4. Arrows indicate flow paths and directions of motion. The well 2, see FIG. 1, is provided with casing 6 perforated through the reservoir 4. A lower dry seal plug/element 20 provided with a seal 22 tightening against the casing 6, a shut-off valve 24, communication/battery module 26 and wire connections, not shown, between the valve 24 and the communication/battery module 26, shuts off an underlying well section, which forms a chamber 8. A combination tool 30 comprising a reservoir inflow valve 32, circulation outlet valve 34, measuring instrument 36, communication/battery module 38 with associated wire connections, not shown, is sealingly attached to the lower end portion of tubing 10 and run into the well 2, and is located in the reservoir 4. The combination tool 30 may be provided with one or more sampling devices 39, see FIG. 6, each typically comprising an air chamber 40 at atmospheric pressure, a sample chamber 42, a pressure-equalizing chamber/nitrogen chamber 47 and a filling valve 45. A closed choke/shut-off valve 41 connects the air chamber 40 to the upper portion of the sample chamber 42. The sample chamber 42 is provided with an upper partition piston 43 and a lower partition piston 44. The space formed in the sample chamber 42 between the partition pistons 43 and 44 communicates with the closed space 14 of the combination tool 30 through a filling valve 45. The filling valve 45 is open. The cavity of the sample chamber 42 above the upper partition piston 43 is filled with oil or other suitable pressure fluid. The space of the sample chamber 42 located below the lower partition piston 44 communicates with the upper portion of the pressure-equalizing chamber 47 through a shut-off valve 46. A partition piston 48 in the pressure-equalizing chamber 47 forms a demarcation between a pressure fluid present above the partition piston 48 and a nitrogen gas present on the opposite side of the partition piston 48, essentially being at the pressure level of the well. All partition pistons 43, 44 and 48 are provided with seals 49 sealing against the internal surfaces of the respective chambers. One partition piston or more may be replaced by membranes.

The lower dry seal plug/element 20 may be fast with the combination tool 30, as appears from the drawings, or form an independent unit. An upper dry seal plug/element 50 is positioned in the annulus 12 between the casing 6 and the tubing 10. The upper dry seal plug/element 50 may be fast with the tubing 10 at a fixed distance from the combination tool 30, or it may be pumped down to the desired position, where, possibly, it is secured to the tubing 10 and/or the casing 12 through a securing device not shown. The upper dry seal plug/element 50 is provided with a seal 52 tightening against the casing 6, a seal 54 tightening against the tubing 10, a valve 56, a communication/battery module 58 and wire connections, not shown, between the valve 56 and the communication/battery module 58. A batching pig 60 comprising a seal 62 tightening against the inner diameter of the tubing 10, a valve 64 and a communication/battery module 66 with associated wire connections, not shown, is pumped down the tubing 10. A closed space 14 is thus formed between the batching pig 60 and the combination tool 30 when the valves 32, 34, 24 and 64 are closed. All valves and measuring devices are remote-controlled from the surface by means of e.g. acoustic signal transmission according to technique known in itself.

Cleaning fluid may be supplied to the well 2 before the combination tool 30 is run into the well 2, or the cleaning fluid may circulate from the annulus 12 through the valves 54, 34, and 64 to the tubing.

Figure 2:
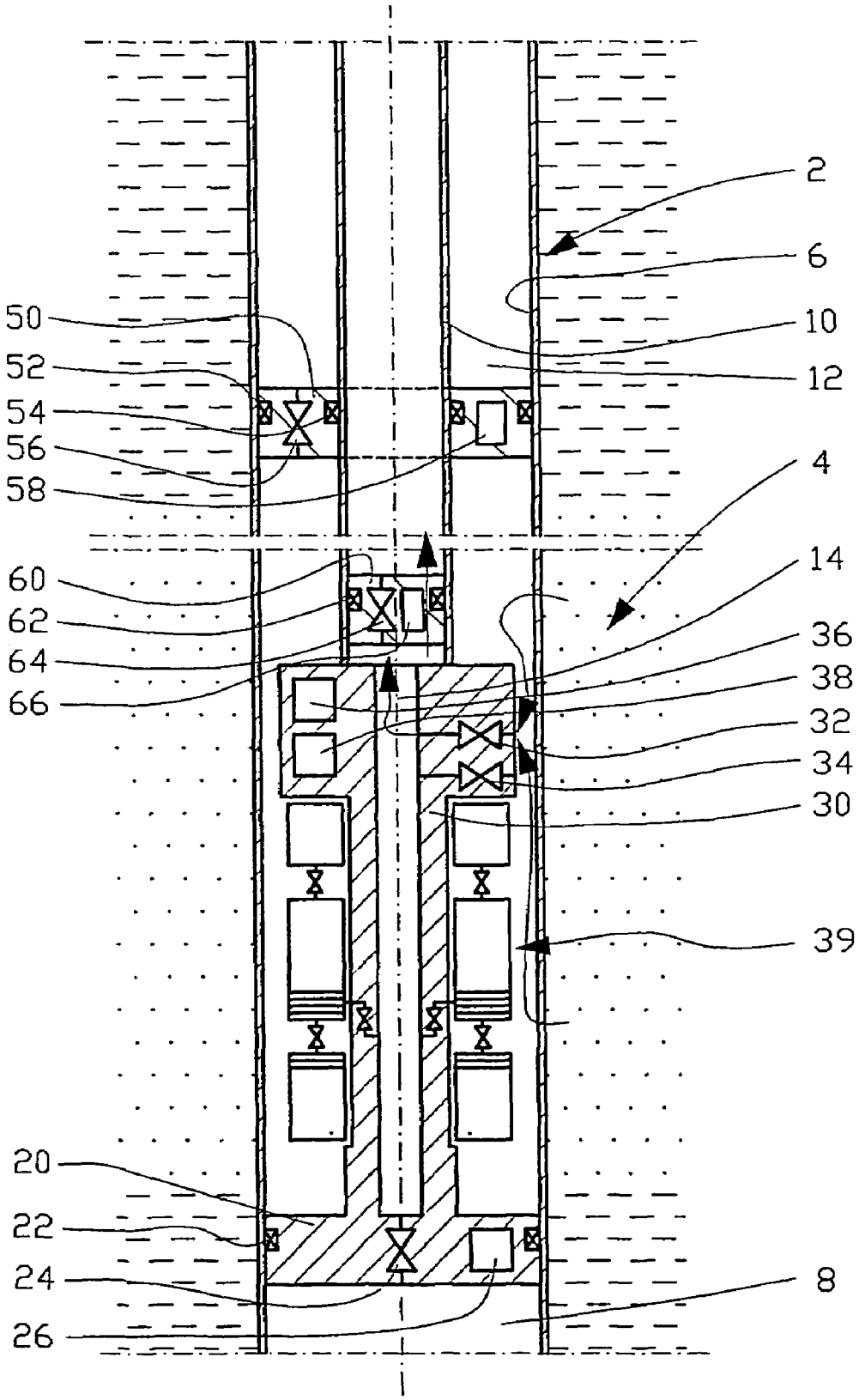
FIG. 2 shows schematically the well of FIG. 1 as reservoir fluid contaminated with drilling fluid is entering the tubing.
Figure 3:
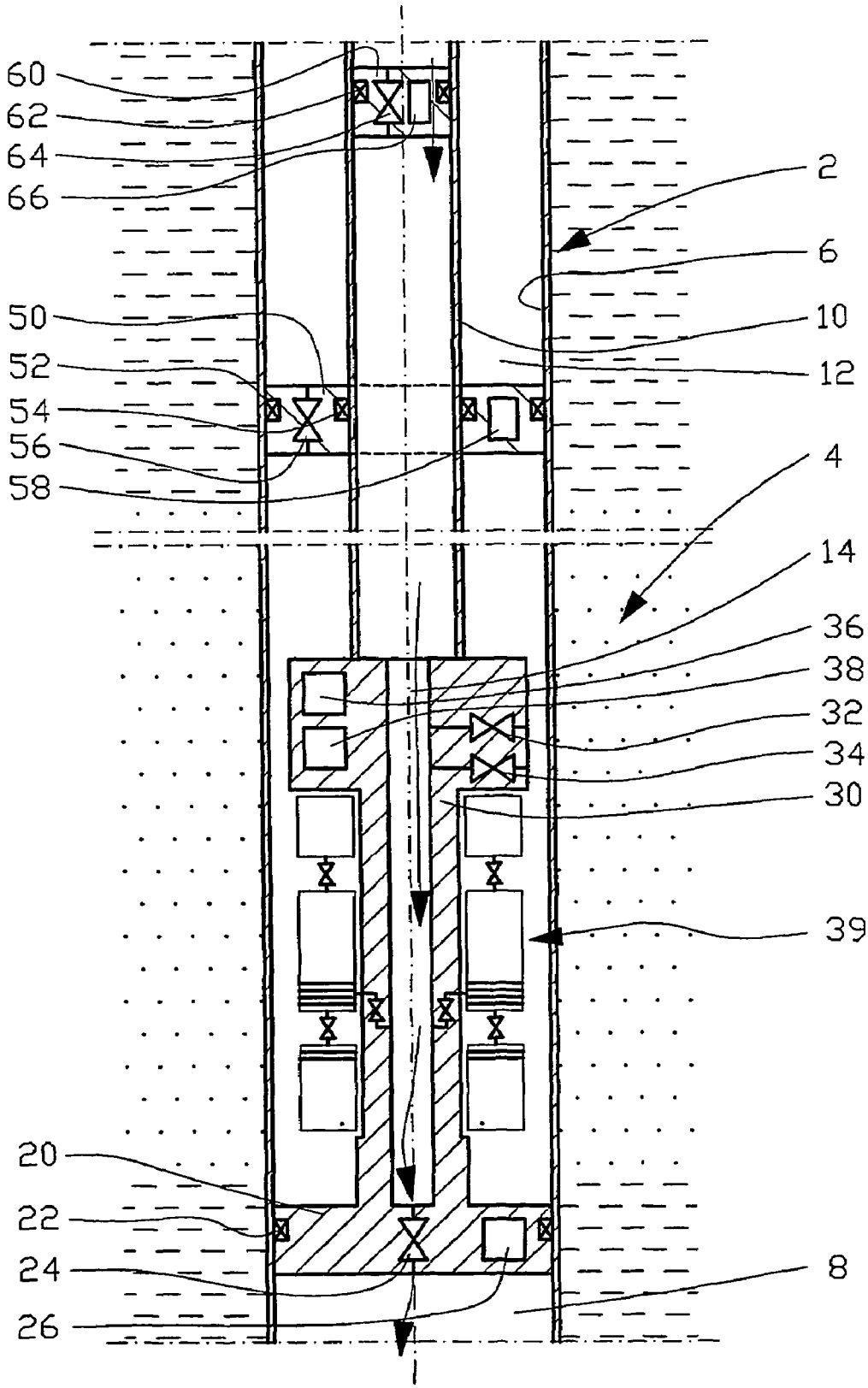
FIG. 3 shows schematically the well of FIG. 1 as contaminated reservoir fluid is flowing down into a chamber below the lower dry seal plug/element.
Figure 4:
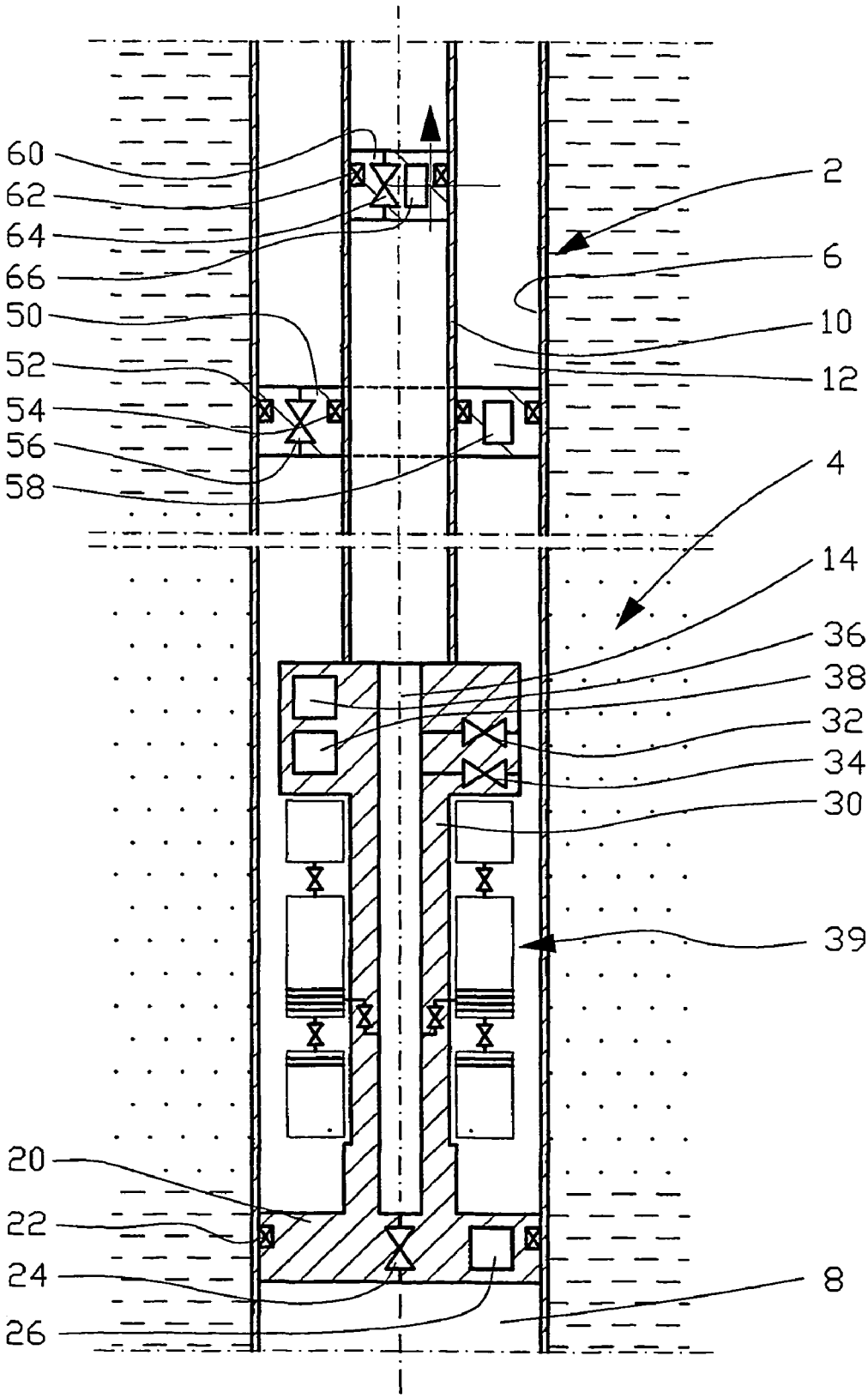
FIG. 4 shows schematically the well of FIG. 1 during volume pressure temperature testing.
Figure 5:
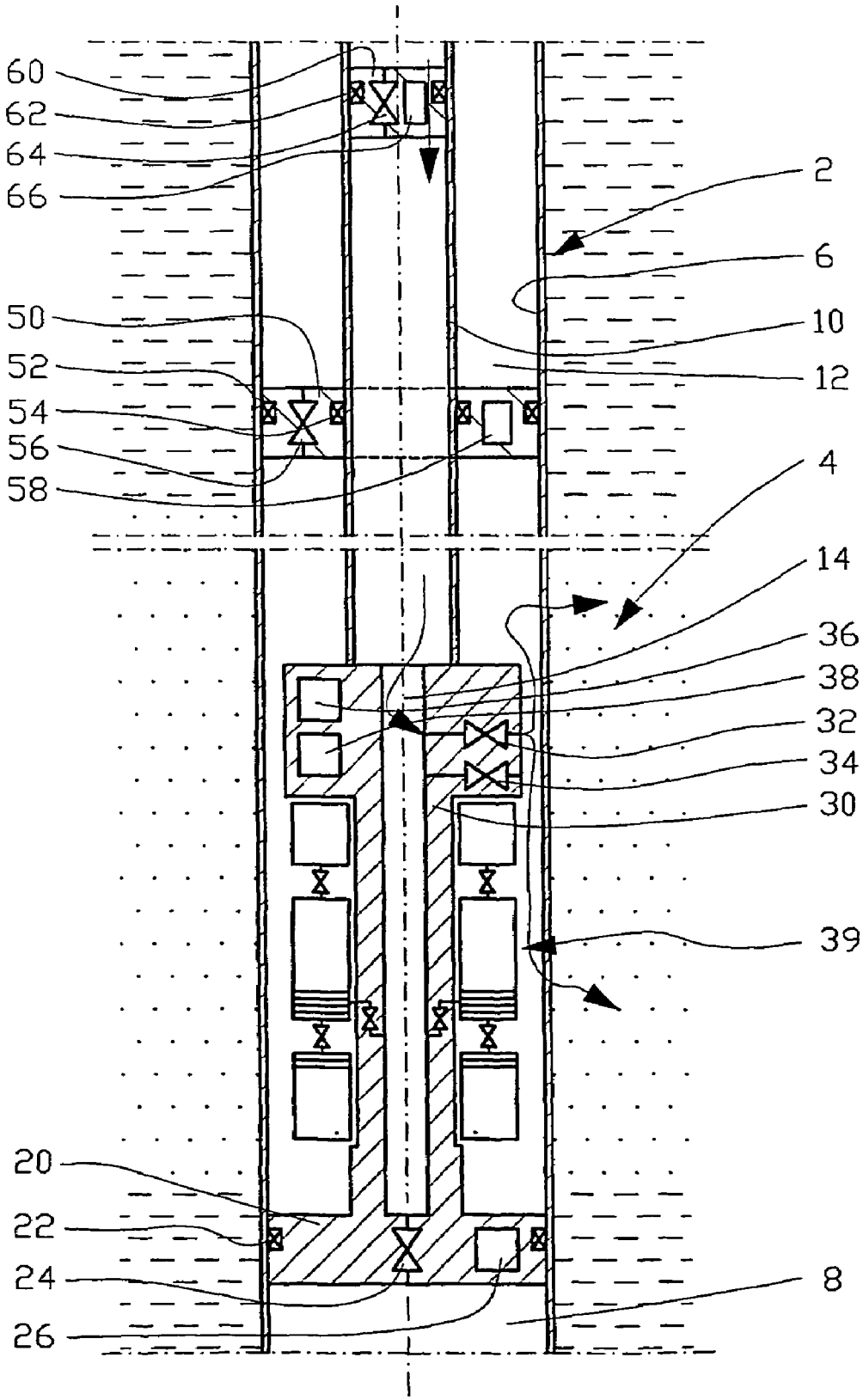
FIG. 5 shows schematically the well of FIG. 1, as clean reservoir fluid is being pumped back into the reservoir.

In a typical method according to the invention, called alternative A in the above, a valve, not shown, is opened at the surface for fluid to flow out of the tubing 10. Said valve is placed at the upper end portion of the tubing. Reservoir fluid flows together with remnants of drilling fluid through the reservoir inflow valve 32 into the combination tool 30, displacing the batching pig 60 upwards while the entering fluid is measured with respect to added tracer at the same time, see FIG. 2. When the reservoir section of the well has been cleaned of tracer and thereby drilling fluid, the reservoir inflow valve 32 is closed, the shut-off valve 24 is opened, and fluid present below the batching pig 60 in the tubing 10, flows by means of pressure on the top side of the batching pig 60 down into the chamber 8, see FIG. 3. In alternative B of the method the contaminated reservoir fluid flows through the valve 64 of the batching pig 60 to the surface. The shut-off valve 24 is closed and the reservoir inflow valve 32 is opened, whereby the batching pig 60 is displaced upwards in the tubing 10 by the entering reservoir fluid in the same way as that shown in FIG. 2. When there is a sufficient amount of clean reservoir fluid in the tubing 10, the reservoir inflow valve 32 is closed, see FIG. 4. The batching pig 60 is then displaced gradually upwards by draining fluid from above the batching pig 60, while, at the same time, reservoir fluid present in the tubing 10 between the batching pig 60 and the combination tool 30 is measured with respect to volume, pressure and temperature. Other measurements, as described above, may be carried out at the same time. When the measuring is completed, the reservoir fluid present in the tubing 10 may possibly be pumped back into the reservoir by opening of the reservoir inflow valve 32 and possibly also the valve 64 of the batching pig, see FIG. 5.

When, during testing, it is desired to take a sample in one of the sampling devices 39, which is arranged to receive a minor amount of reservoir fluid, and to make sure that this sample is kept at constant pressure and/or temperature until it is subsequently to be analysed in a laboratory, the choke/shut-off valve 41 is operated into its open position, e.g. by an acoustic signal from the surface through receivers and actuators not shown. The pressure oil present in the upper part of the sample chamber 42 is flowing at a predetermined rate through the choke/shut-off valve 41 into the air chamber 40. The upper partition piston 43 is displaced upwards by the reservoir fluid entering through the filling valve 45.

When the upper partition piston 43 reaches its top position by full sample chamber 42, a sensor/switch/initiator, not shown, is operated, closing the filling valve 45 and opening the valve 46 through connections and actuators, not shown, whereby the pressure fluid within the equalizing chamber 47 may communicate with the volume below the lower partition piston 44 of the sample chamber 42. The pressure gas in the pressure-equalizing chamber 47 ensures that temperature variations during transport to the laboratory will not insignificantly affect the pressure of the sample.

In an alternative sampling device the air chamber 40 and the sample chamber 42 with the choke/shut-off valve 41 are surrounded by an insulated and temperature-controlled container (thermos bottle). The temperature control may be carried out by means of an accumulator-operated thermostat-controlled heating foil, e.g. Pressure compensation will not be necessary by this solution.

In the method according to the invention, in which the reservoir fluid stays all the time in the reservoir or in the immediate vicinity thereof, it is achieved that pressure and temperature drops are avoided in connection with transport and transfer of pressurized transport containers, while at the same time the testing may be carried out without causing contamination from the burning of reservoir fluid. A substantial reduction in test time is achieved.

The invention claimed is:

1. A method for measuring physical quantities in a well, to be used in connection with wells of the kind relevant in the recovery of petroleum, characterized by:

forming a lower seal in the well;

lowering a combination tool attached to tubing to a desired position above the lower seal;

forming an upper seal between the well and the tubing;

lowering a batching pig into the tubing to form a closed space of the well;

allowing an amount of reservoir fluid to enter a combination tool at least until a clean reservoir fluid is detected to displace contaminated fluid in the closed space;

disposing of the contaminated fluid; and measuring the physical properties of the reservoir fluid.

2. A method according to claim 1, characterized in that an amount of clean reservoir fluid is carried into, and shut off in, a closed space of the well, after which the volume of the space is adjusted.

3. A method according to claim 2, characterized in that in connection with the adjustment of the volume of the closed space measuring of physical, chemical and thermodynamic quantities relating to the shut-in fluid, saturation pressure and flow data, is carried out in order to determine the flow properties of the reservoir.

4. A method according to claim 1, 2 or 3, characterized in that the reservoir fluid contaminated with drilling fluid is flowing to the surface.

5. A method according to claim 1, 2 or 3, characterized in that the reservoir fluid contaminated with the drilling fluid is pumped to a separate well chamber.

6. A method according to claim 1, 2 or 3, characterized in that the reservoir fluid present in the closed space is returned to the reservoir.

7. A method according to claim 2 or 3, characterized in that the reservoir fluid present in the closed space is returned to a reservoir of the well other than the one that the fluid originally came from.

8. A method according to claim 2 or 3, characterized in that the closed volume is located at reservoir level, possibly in the immediate vicinity of the reservoir.

9. A method according to claim 1, 2 or 3, characterized in that smaller quantities of well fluid are flowing at controlled rates into a removable sample chamber which is shut off from the supply, after the desired quantity has been received, and is then pressure-compensated.

10. A method according to claim 1, 2 or 3, characterized in that smaller quantities of well fluid are flowing at controlled rates into a removable sample chamber which is shut off from the supply, after the desired quantity has been received, and is then temperature-controlled.

* * * * *